US005588387A

United States Patent [19]

Tellington

[11] Patent Number: 5,588,387

[45] Date of Patent: Dec. 31, 1996

[54] FLOATING PLATFORM

[76] Inventor: Wentworth J. Tellington, P.O. Box 68291, Tucson, Ariz. 85737

[21] Appl. No.: 404,049

[22] Filed: Mar. 14, 1995

Related U.S. Application Data

[63] Continuation-in-part of Ser. No. 154,119, Nov. 18, 1993, Pat. No. 5,398,635.

[51] Int. Cl.[6] ..... B63B 35/44

[52] U.S. Cl. ..... 114/261; 114/264

[58] Field of Search ..... 114/56, 57, 261, 114/61, 121, 266, 123, 265, 292, 264, 283; 440/9, 10

[56] References Cited

U.S. PATENT DOCUMENTS

| | | | |
|---|---|---|---|
| 1,513,591 | 10/1924 | Dorr et al. . | |
| 1,753,399 | 4/1930 | Blair . | |
| 1,854,336 | 4/1932 | King . | |
| 2,133,721 | 10/1938 | Seidman | 244/114 |
| 2,342,773 | 2/1944 | Wellman | 114/43.5 |
| 2,347,959 | 5/1944 | Moore et al. | 114/61 |
| 3,002,484 | 10/1961 | Dube | 114/61 |
| 3,191,566 | 6/1965 | Wilken et al. | 114/43.5 |
| 3,541,987 | 11/1970 | Barkley | 114/61 |
| 3,604,382 | 9/1971 | Sorrenti | 114/61 |
| 4,389,843 | 6/1983 | Lamberti | 440/9 |
| 4,684,350 | 8/1987 | DeLima | 440/9 |
| 4,744,529 | 5/1988 | Clarke | 244/114 |

*Primary Examiner*—Stephen Avila
*Attorney, Agent, or Firm*—Antonio R. Durando

[57] ABSTRACT

A floating platform that includes a plurality of floating modules flexibly coupled to one another. Each module includes at least one buoyant hull removably attached to its underside and capable of vertical and rotational movement to absorb the action of ocean waves. In the preferred embodiment, buoyancy is provided by pairs of pontoons pivotally attached to a walking beam hingedly coupled to the underside of the platform. In addition, each pontoon is equipped with splash trays and scuppers to minimize the impact of waves striking the underside of the module. Each module is separately maneuverable for independent attachment to the floating structure while afloat off-shore. Male/female couplers and tie lines are used that enable a quick and safe connection of each additional module to the floating structure. A system of propulsion jets is provided on all sides of the assembled floating platform to permit the motion of the structure in any desired direction relative to the water. The anchoring of the structure is achieved by continuously monitoring the horizontal position of its center of gravity and by utilizing the propulsion system to avoid any significant movement with respect to a predetermined location.

20 Claims, 6 Drawing Sheets

FLOATING PLATFORM

RELATED APPLICATIONS

This is a continuation-in-part application of U.S. Ser. No. 08/154,119, filed by the same inventor on Nov. 18, 1993, and noticed for issuance on Mar. 21, 1995, as U.S. Pat. No. 5,398,635.

BACKGROUND OF THE INVENTION

1. Field of the Invention

This invention pertains to the general field of floating structures and, in particular, to floating platforms of modular construction.

2. Description of the Prior Art

As the population of the world increases and large cities expand over crowded shores, floating platforms have become an acceptable location for strategic and commercial activities. In my copending application I described a concept for a floating airport capable of accommodating a large number of aircraft as an alternative to civil and military aviation's reliance on thousands of airports strategically located on land around the world and on airplane carriers at sea. Modern airports have become mazes of runways, hangars and terminals used to move millions of people and tons of cargo material every day. Problems of congestion, security, safety, noise, pollution, and distance from residential areas all contribute to sometime contradictory solutions for urban airports. The high traffic volume of a modern metropolis requires sufficient runways to take care of very frequent landings and take-offs. Therefore, even smaller airports have multiple runways spread out over several square kilometers of premium land. In addition, since the optimal direction for both take-off and landing maneuvers changes with the direction of the prevailing wind, multiple sets of intersecting runways are usually provided, creating a system of paved roads many kilometers long in all directions. This causes airplanes to taxi over long distances before and after each flight, wasting fuel and passenger time and contributing to environmental pollution.

One other aspect of urban airports is that they need to be accessible and yet be far enough from residential areas to avoid unacceptable levels of noise. As a result, they are either placed tens of kilometers from town or the flight patterns are adjusted to avoid maneuvers directly over populated areas. The former case complicates the logistics of travel for the average passenger who has to face a relatively time-consuming journey to and from the airport in addition to flight time. The flight pattern constraints are particularly significant in bad weather because they force the performance of suboptimal landings as a result of the restrictions, increasing the danger of mid-air collisions and of problems on impact.

The invention disclosed in my copending application is directed at a floating-airport concept that solves many of these problems. Various inventions have been described in the prior art to address particular air navigation needs. For example, U.S. Pat. No. 1,513,591 to Dorr et al. (1924) discloses the idea of a floating hangar for airships based on a single-hull design. The invention first introduces the concept of utilizing the unitary construction of a ship's hull to provide the buoyancy required for supporting the shed above water. Flood chambers are used to raise or lower the bottom of the hanger to the desired elevation with respect to water level. The structure is provided with a single-point anchoring system that permits the rotation of the shed to face the wind. Although the purpose of this feature is not expressly stated, it was presumedly intended for stability and for facilitating the process of taking airships aboard.

U.S. Pat. No. 1,854,336 to King (1932) describes a floating landing strip, seemingly a precursor to modern airplane carriers. The invention relates to a runway supported by multiple submergible pontoons that permit the raising or lowering of the unit. The structure is propelled and intended for navigation and anchoring on large bodies of water.

In U.S. Pat. No. 1,753,399 (1930), Blair describes an ocean-going aircraft-carrying structure with a system of hulls designed to reduce the impact of wave motion. The bulk of the volume of the hulls is under the water level, so that the impact of surface-water motion is minimized.

In U.S. Pat. No. 2,133,721 (1938), Seidman describes an airplane terminal having a submersed rotating platform for retrieving and releasing aquatic airplanes. The invention is directed at means for coordinating passenger and cargo traffic between land and arriving or departing hydroplanes.

U.S. Pat. No. 2,342,773 to Wellman (1944) discloses a landing platform formed on the surface of a body of water adjacent to a ship. The platform is made with material carried by the ship in rolled form and reeled offboard over the water to create a landing strip when needed. Inflatable compartments are provided for buoyancy.

U.S. Pat. No. 3,191,566 to Wilken et al. (1965) shows a waterborne craft for airplanes capable of attaining the normal speed of a plane during landing. As a result of this feature, which is achieved with hydrofoil technology, the vessel is able to provide a relatively stationary target for landing airplanes and to enhance the take-off air velocity of departing aircraft.

Finally, U.S. Pat. No. 4,744,529 to Clarke (1988) teaches a system for recovering disabled airplanes in water. It consists of a large net having sufficient size to accommodate an aircraft during landing in water and comprises floats for supporting the net and craft. The system is designed for emergency operation in conjunction with a tug boat.

None of the concepts described by the prior art had addressed the particular modern-airport problems mentioned above, or suggested solutions to them. Therefore, the floating-airport concept of my copending application provides a useful new approach to airports that optimizes space utilization, safety, convenience, and efficiency of operation.

During the course of refining the design of such a floating-airport structure, I have developed a method and details of construction that I found to be generally applicable to any floating platform. This could be, for example, a residential or office complex, a floating recreational platform, a waste disposal plant, a chemical manufacturing facility, an oil refinery, a transhipping dock or warehouse, or any other industrial, commercial, scientific, or military off-shore facility. This disclosure is directed at such details and a novel construction approach generally applicable to off-shore floating platforms.

BRIEF SUMMARY OF THE INVENTION

It is therefore an objective of this invention to provide a new concept in airport design based on a floating structure located on a body of water in the proximity of an urban center, providing a water buffer between airstrips and residential areas in all directions, such that landings and take-offs may occur in all directions with minimal disturbance to populated areas.

Another objective of the invention is a structure that can be rotated to face the prevailing wind, so that a single set of parallel runways is sufficient to ensure optimal landing and take-off conditions at all times.

Another goal of the invention is a method of continuously monitoring and controlling the position of the platform to ensure its stability under all weather and water conditions.

A further objective of the invention is a modular approach to the design of the airport structure that is suitable for repairs, additions and modification over a long period of operation.

Another goal of the invention is a system of supporting hulls to provide the required buoyancy in a stable manner under all wave conditions and nearly unaffected by surface water motion.

Another goal of the invention is the utilization of known scientific principles in combination with existing technology, including sensory, computing, control, communication and other devices, for the achievement of the above-stated objectives.

Finally, an objective of the invention is a method of construction that is suitable for assembling and operating floating structures, irrespective of intended use.

Thus, in accordance with these and other objectives, the floating platform of this invention comprises a main frame that consists of a plurality of floating modules flexibly coupled to one another. Each module includes at least one buoyant hull removably attached to its underside and capable of vertical and rotational movement to absorb the action of ocean waves. In the preferred embodiment, buoyancy is provided by pairs of pontoons pivotally attached to a walking beam hingedly coupled to the underside of the platform. In addition, each pontoon is equipped with splash trays and scuppers to minimize the impact of waves striking the underside of the module. Each module is separately maneuverable for independent attachment to the floating structure while afloat off-shore. Male/female couplers and tie lines are used that enable a quick and safe connection of each additional module to the floating structure.

A system of propulsion jets is provided on all sides of the assembled floating platform to permit the motion of the structure in any desired direction relative to the water. The anchoring of the structure is achieved by continuously monitoring the horizontal position of its center of gravity and by utilizing the propulsion system to avoid any significant movement with respect to a predetermined location. In the case of a floating airport, the structure is allowed to rotate approximately around its vertical axis in order to align the runways with the prevailing winds and minimize the winds' impact on its stability, but any translational motion of the center of gravity of the airfield with respect to the water surface is minimized. As a result of this position control strategy, the structure is prevented from ever acquiring significant linear momentum in spite of its large mass and its position can be continuously controlled with relatively minor adjustments that are within the capability of its propulsion system.

Various other purposes and advantages of the invention will become clear from its description in the specification that follows, and from the novel features particularly pointed out in the appended claims. Therefore, to the accomplishment of the objectives described above, this invention consists of the features hereinafter illustrated in the drawings, fully described in the detailed description of the preferred embodiments and particularly pointed out in the claims. However, such drawings and description disclose only some of the various ways in which the invention may be practiced.

DETAILED DESCRIPTION OF THE INVENTION

The idea of designing an airport, or any other industrial or commercial facility, as a floating structure provides a simple theoretical solution to the problems of modern airfields and similar problems of such other facilities. In practice, though, the implementation of the idea requires a practical solution to many issues that are critical to the viability of the concept. The main issue concerns a method of stably anchoring a floating structure of the size of an airport and safely securing its position under all weather conditions. Huge ships, such as aircraft carriers, have been built and are obviously routinely secured at will by anchoring systems that tie them to fixed structures such as piers or the ocean floor. These anchoring means, though, are not deemed reliable enough for a structure that is much larger and heavier than any ship ever built and that is not designed for travel, therefore lacking sufficient self-propulsion to meet emergency situations. The floating airport of the invention is contemplated to comprise at least two decks (although a single-deck construction would also fall within the scope of the invention) and span over an area about 1,000 meters wide and 5,000 meters long. No anchoring system has ever been devised that could be relied on for such a massive structure. An important contribution of this invention is to provide a means for safely and reliably securing the position of such a floating structure.

In addition, this disclosure describes various construction details that have general application for any large-scale floating platform. Specifically, I describe a modular-construction approach that makes it possible to assemble such a massive structure on site and ensures the degree of flexibility required to withstand the winds and waves of harsh weather conditions. I also describe a system of connection of the floating supports to the main structure that greatly increases stability and safety.

Figure 1:
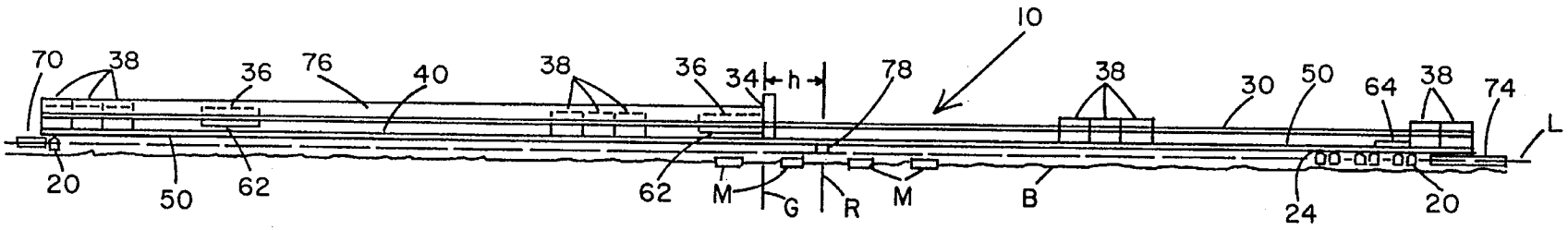
FIG. 1 illustrates in elevational side view the general configuration of a floating airport according to this invention consisting of an upper flight deck, a lower service deck and partially-submerged modular pontoons to support the deck structure afloat.

Referring to the drawings, wherein the same reference numerals and symbols are used throughout to designate like parts, FIG. 1 illustrates in elevational side view the general configuration of a floating airport 10 according to this invention. The preferred embodiment is described throughout in terms of an airport, but it is understood the features of the invention are equally applicable to any large-scale floating structure, such as an industrial facility, a commercial enterprise, or even a housing development.

Figure 2:
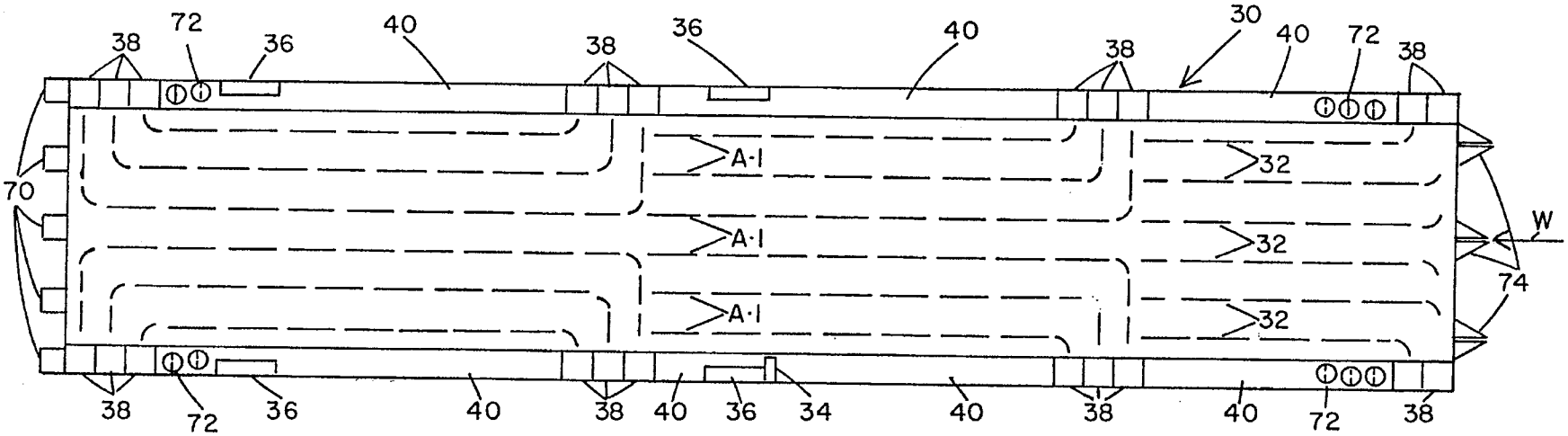
FIG. 2 is a schematic plan view of the upper flight deck of the invention.
Figure 3:
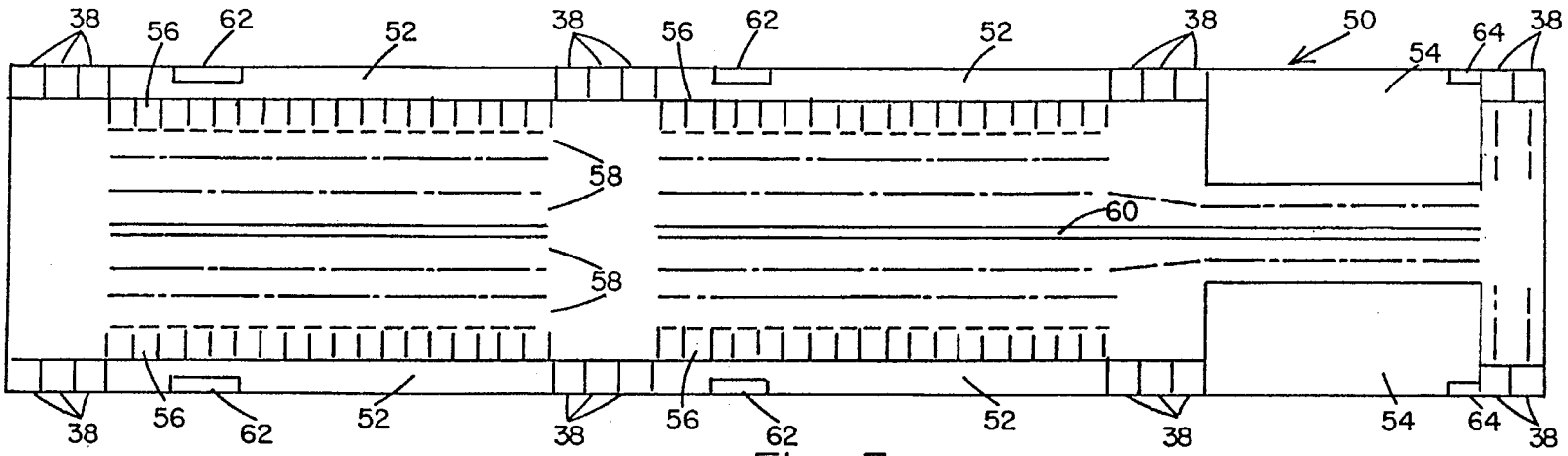
FIG. 3 is a schematic plan view of the lower service deck of the invention.

The airport 10 is shown as comprising multiple decks (two are shown in the figures and used in this disclosure for illustration, but only one as well as more than two could obviously be utilized in equivalent fashion) supported by a plurality of floating pontoon hulls removably attached to the bottom of the lower deck. As seen in the figure, each pontoon hull 20 is partially submerged under the surface L of the body of water supporting the airport and provides buoyancy to the structure. As also illustrated in the schematic plan view of FIG. 2, an upper flight deck 30 contains multiple longitudinal runways 32 (shown with reference to directional arrows A1), at least one flight-control tower 34, helicopter pads 36, elevators 38 connecting the top deck 30 to a lower service deck 50, and several emergency/safety areas 40. The lower deck 50, shown in schematic plan view in FIG. 3, comprises passenger ticket/baggage areas 52, aircraft maintenance and repair facilities 54, airplane parking bays 56, airplane-tow traffic lanes 58 for arrival and departure, and at least one tow vehicle lane 60. The airplanes are moved to and from the upper deck 30 by means of the elevators 38 connecting the two decks. Passenger-boat landings 62 and service-boat landings 64 are provided along the perimeter of the lower deck for accessing the airport by boat from shore.

Figure 4:
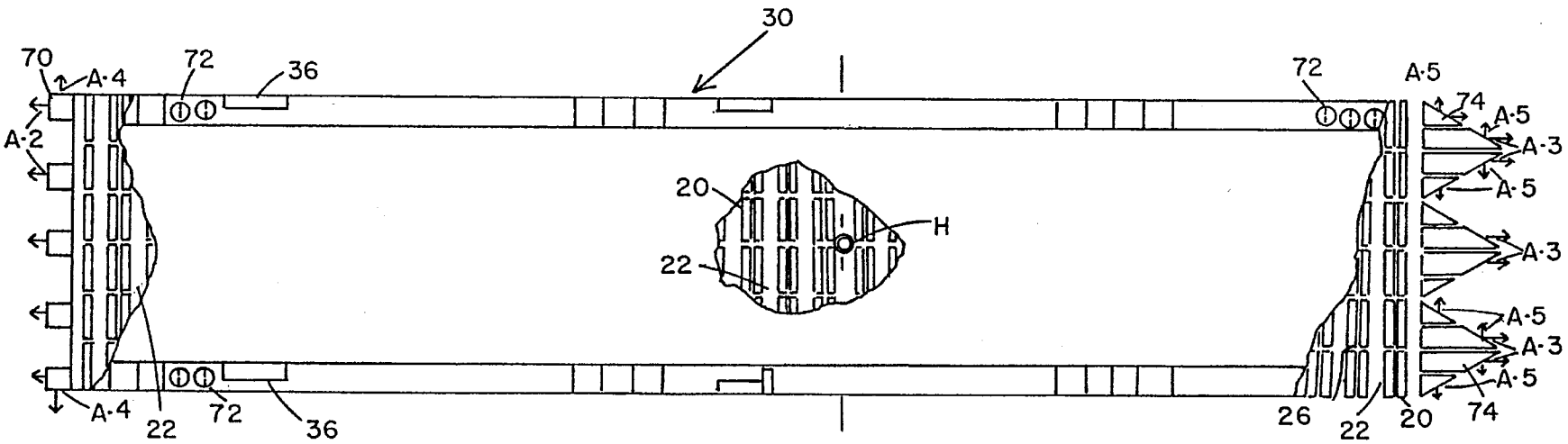
FIG. 4 is a schematic plan view of the airport of the invention with cut-out portions to illustrate the layout of the supporting floating hulls.
Figure 6:
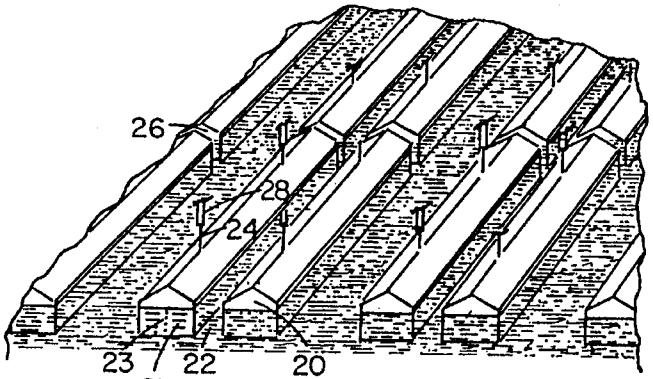
FIG. 6 is an enlarged perspective view of the floating hulls to illustrate their transverse arrangement to form longitudinal wind channels therebetween.
Figure 5:
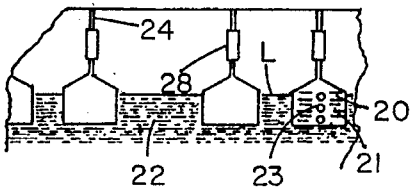
FIG. 5 is an enlarged elevational view of the floating hulls of the invention to illustrate their longitudinal arrangement to form transverse access channels therebetween.

Cut-out portions of FIG. 4 show in plan view the layout of the floating hulls 20 within the structure of the floating airport. Each hull 20 consists of an independent module with sufficient buoyancy to support its own weight and also a portion of the weight of the multi-deck structure in proportion to the total number of hulls used. Each hull is mounted to the bottom of the lower deck and preferably placed adjacent to another hull transversely along the width of the airport, each pair of hulls being sufficiently apart from other pairs to form transverse access channels 22 therebetween that can be used for maintenance or for removing and replacing damaged hulls. As illustrated schematically in FIGS. 5 and 6, each hull 20 can be removably secured to the lower deck 50 through posts or equivalent means 24 and each pair of hulls 20 is also uniformly spaced from laterally adjacent pairs to form longitudinal wind channels 26. This modular-hull concept is greatly preferred over a very large single hull because it facilitates movement of the overall structure by providing longitudinal and lateral channels of flow for the surrounding water, thus affording much greater flexibility of operation and maintenance. It is calculated that approximately 500 modular hulls (each about 150 meters long and 30 meters wide) would be required to support a five-kilometer long airport structure; a single-hull approach would make lateral movement of such a structure virtually impossible because of the huge barrier it would provide to water flow.

Although not specifically illustrated in the drawings, large-scale construction techniques well known to those skilled in the art can be used for removably mounting each hull 20 under the airport's multi-deck structure. As shown for illustration on one of the posts 24 of FIG. 6, a hydraulic cylinder 28 can be used to provide shock absorption, so that vertical surges of the water surface are prevented from causing rapid movements of the decks and resulting stresses on the structure are reduced. Each hull 20 is independently equipped with flood chambers 21 and pumps 23 (shown only on one hull for simplicity) to control its buoyancy, so that the floating platform may be raised or lowered with reference to the water level as weather or other conditions may warrant. Similarly, a null may be lowered with respect to the others to facilitate its disengagement from the structure and removal via the access channels 22.

The propulsion system of the preferred embodiment of the invention consists of a plurality of large water jets disposed preferably in the fore and aft portions of the structure below the water surface. Because of the method adopted to control the position and stability of the floating structure, only a limited number of jets is critical to provide the necessary mobility. In operation, the airport is oriented to always face the prevailing wind W, so that forward propulsion is constantly required under normal conditions to overcome the force of the wind and keep the airport stationary. Thus, banks of pump-driven stern jets 70 adapted to eject directly to the rear of the structure (as indicated by arrows A2 in FIG. 4) are used to provide forward thrust. By mounting a series of wind generators 72 in strategic positions along the flight deck or on the sides of the structure, the force of the wind can concurrently be used to generate power for operating the jet pumps. Since the forward thrust required to maintain the longitudinal position of the airport and the power generated by the wind generators will both be proportional to the force of the wind at all times, additional power requirements are minimized by this combination. Banks of smaller bow jets 74 (propelling forward in the direction of arrows A3 in FIG. 4) are similarly used to thrust the structure 10 backwards in case of a sudden reversal of wind direction. Inasmuch as the direction of the wind is to be monitored and forecast continuously and used for controlling the attitude of the airport to ensure its windward position at all times, thereby being normally subjected to a bow head wind, it is expected that these jets would rarely be used and are provided for emergency situations only.

Steering of the structure 10 is achieved by lateral jets which may be incorporated within the banks 70 and 74 in the stern and bow portions of the airport. When the wind direction changes or the structure rotates, thereby facing the wind either at port or starboard, steering for realignment can be achieved by jets that take in water from one side of the bank and propel it toward the opposite side. As indicated by arrows A4 in FIG. 4, the stern jets are adapted to provide thrust in either lateral direction, depending on the wind, and are used so as to eject on the windward side with intake from the leeward side. Similarly, as indicated by arrows A5, the bow jets are adapted to provide thrust in either lateral direction as well, but they are used so as to eject on the leeward side with intake from the windward side. This mode of operation of the jet banks creates a torque approximately about the vertical axis of the structure 10 and permits its longitudinal realignment with the direction of the wind simply by rotation around that axis and substantially without translational displacement of the center of gravity.

Figure 7:
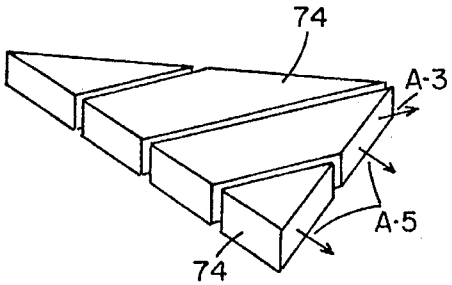
FIG. 7 is an enlarged perspective view of the propulsion-jet banks in the bow of the airport structure to illustrate their aerodynamic and hydrodynamic profile.
Figure 12:
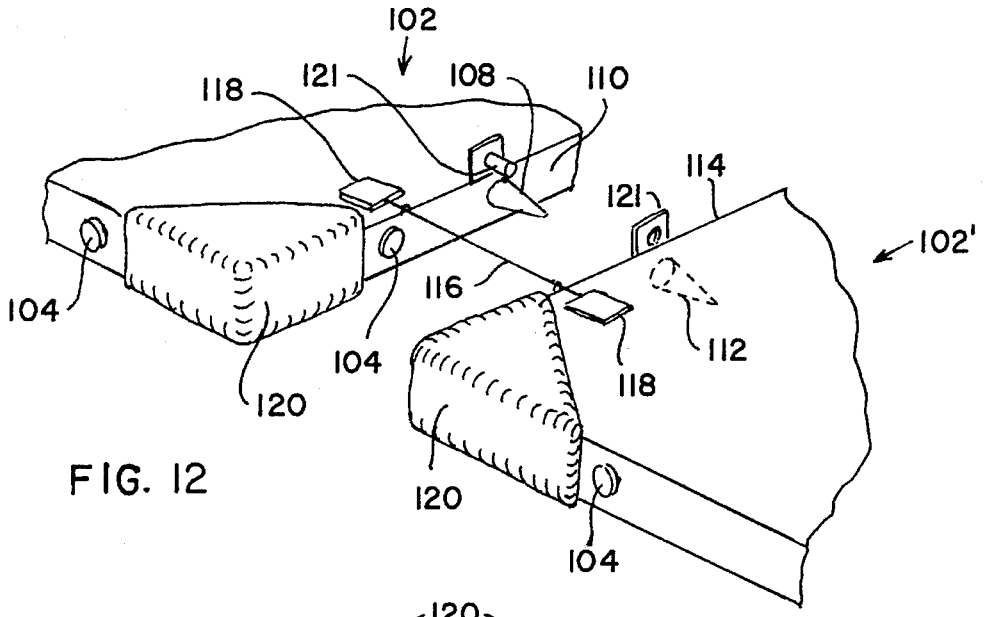
FIG. 12 is a simplified perspective view of corner portions of the modules in FIG. 11 to illustrate the method of connection between modules.

Because of the elongated shape of the structure 10 and the presence of the wind channels 26 between the water surface and the bottom of the lower deck 50, the wind itself provides a force tending to maintain the longitudinal alignment of the airport in windsock fashion. As illustrated in schematic form in FIG. 7, the banks of jets 74 in front of the airport are preferably shaped with an aerodynamic and hydrodynamic profile in the longitudinal direction, designed to direct the wind in fin fashion into the wind channels 26. This effect is magnified by providing greater wind resistance on the portion of the structure behind its vertical axis, such as by lateral shields 76 (see FIG. 1), than on the fore portion of the airport. In fact, the front portion of the airport is purposefully largely open and wind absorbing, while the rear portion is preferably completely walled in to help its rotation.

In addition, the effect of the wind is further enhanced by controlling the rotation of the structure so that the axis of rotation R (FIG. 1) is kept in front of its vertical axis G (which, by definition, passes through the center of gravity), thus creating a torque with an arm equal to the distance h between the axis of rotation and the center of gravity with a component in the direction required to effect the longitudinal realignment of the airport. It is estimated that a distance h of 250 meters would be optimal for a 5-km long deck structure; that is, the optimal lever arm for the purposes of this invention is estimated to be about 5 percent of the length of the structure. A range of zero to 25 percent may be used under different conditions. For example, the distance h may be changed during operation as a result of a change in the load distribution on the structure 10, such as when an unusual number of heavy airplanes is stowed away in a particular area like a maintenance hanger or the like. Thus, the control stability of the floating airport can be further improved by dynamically adapting the distance h to an optimal value for given weight-distribution and weather conditions, as one skilled in the art would be able to determine.

The position-control and anchoring system for the floating airport of the invention is not based on structural ties with stationary monuments, such as massive foundations onshore or offshore or on the bottom B of the water body; rather, it is based on the continuous dynamic control of the position of the floating structure 10 while it is free to move on the surface of the water. This freedom of motion makes it possible to always orient the structure longitudinally into the wind, so that the runways are always disposed optimally for landing and take-off irrespective of the wind direction. The stern propulsion system provides the thrust necessary to keep the airfield stationary in the longitudinal direction against the wind, the magnitude of that thrust obviously varying from time to time depending on wind conditions. The position-control system comprises means for sensing the coordinates of the chosen axis of rotation R, illustrated as passing through an imaginary rotation hub H in FIG. 4, with respect to stationary reference points M (at least three are required for triangulation purposes) at the bottom of the water body (FIG. 1), onshore, or on satellites. Such a system could be based on sonar, laser or equivalent technology, as is well known in the art of navigation, and would simply involve telemetry apparatus 78 for generating and/or receiving signals representative of distances from the stationary reference monuments M and data processing apparatus (shown as combined with the referenced apparatus 78) for converting the distance information so acquired into a control signal for activating the proper jets to bring the hub H to its intended position. Angular deviations from the desired longitudinal attitude (which, in the case of an airport, is always determined by the direction of the prevailing wind) would similarly be measured and appropriate action taken. By continuously monitoring the position of the hub H in relation to its intended stationary location and by making adjustments as soon as deviations are measured (both linear and angular), the location and orientation of the airfield can be controlled dynamically and kept substantially fixed, such as if it were rigidly anchored. This feature makes it possible to quickly adjust the orientation of the airstrips to match the wind direction without having to first release the floating structure from a rigid anchoring structure.

Figure 8:
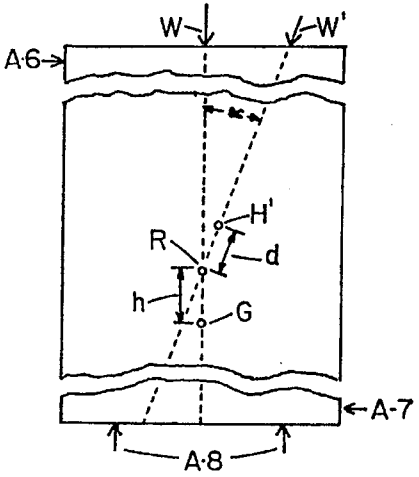
FIG. 8 is a schematic illustration of the control method of the invention.

As illustrated for example in the diagram of FIG. 8, as a result of changes in water conditions or in wind direction from W to W', the hub H will from time to time deviate from its intended stationary position H') by a measurable linear distance d and the direction of the airfield will deviate from its intended wind alignment by an angle $\alpha$. Lateral thrust would then be applied to the port and stern of the structure in the direction of arrows A6 and A7 to cause it to rotate windward about the vertical axis R through the hub H. At the same time, forward thrust in the direction of arrows A8 would be applied at the stern of the structure to move the hub H toward its intended location H'. By continuously monitoring the coordinates and orientation of the hub H with respect to H') and by immediately correcting both linear and angular deviations, the structure is never allowed to deviate substantially from its intended position. The maneuverability of the structure is also enhanced by the modular hull configuration described above, which facilitates the displacement of water that is necessary to allow the structure to move swiftly. Thus, though huge in size and mass, the floating airport is never allowed to develop sufficient linear and/or angular momentum to overwhelm the capacity of its jet propulsion system; rather, it can be controlled continuously within narrow perturbations that ensure a very stable and substantially stationary operation of the structure as a floating airfield.

It is understood that many equivalent systems are possible within the scope of the present invention, with different embodiments, for example, for the decks, propulsion system, and navigation apparatus. In addition, it is understood that various other features would be added to the basic concept for a floating airport in order to construct a fully functional facility. Fuel tanks and lines, sewer and waste disposal apparatus, and a water supply system, which may be based on a self-contained purification plant drawing water from the surrounding body of water, could all be incorporated within the hull structure below the lower deck. In addition, an emergency, stationary anchor could be provided for safety in case of total failure of the onboard systems. Such an anchor would necessarily be kept inoperative under normal conditions, such as by being kept slack within a radius greater than the normal deviation of the hub H from its stationary target H'.

Figure 9:
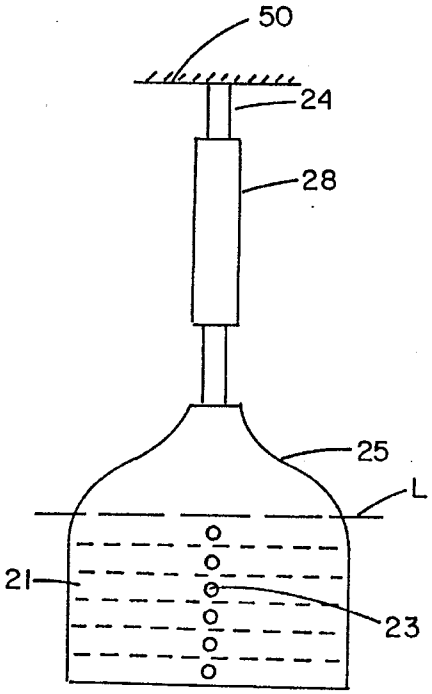
FIG. 9 is an elevational side view of an alternative embodiment of the modular pontoon hulls of the invention.

It is well known that the top few feet of water are mostly affected by adverse weather conditions over a lake or ocean, while the bottom waters tend to remain relatively calm and unaffected by high winds. Accordingly, the stability of the floating structure of the invention can be further enhanced by using a specific embodiment 25 for the supporting floating hulls according to the design shown in cross-section in FIG. 9. Each hull 25 has an approximately pear-shaped cross-section (converging to a thinner top portion) and is also independently equipped with flood chambers 21 and pumps 23 to control its buoyancy, as discussed above for hulls 20. By operating the hull 25 so that the bulk of its volume is well below the surface of the water L, the exposure of the hull to surface conditions is greatly diminished and the airport structure supported by the hulls becomes more stable in bad weather.

In all cases, the length of the posts 24 will be chosen so as to provide sufficient clearance below the lower deck 50 to allow a 20- to 30-foot wave to pass under the structure with limited impact on its stability. This feature can be enhanced by designing the hulls 20 or 25 so that they operate mostly submerged under normal conditions, thus providing minimal resistance to the motion of surface water, which is where most of the turbulence is experienced during bad weather conditions. Through the use of the flood chambers 21 and pumps 23, the position and stability of the structure 10 can be further improved by selectively changing the buoyancy of specific hulls to meet corresponding requirements to balance the weight load throughout the airport. Finally, as an emergency option, the hulls should be capable (through flooding of its chambers) of allowing the sinking of the structure to the point where the bottoms of the hulls rest on the bottom B of the water body, thus providing a stable rigid anchor for the airport that would withstand any foreseeable situation. Because of the expected proximity to shore of airports or other facilities built according to this invention, they would be placed in relatively shallow waters and their hulls in most cases would contact the bottom before the airport became submerged, thus avoiding damage to it even in such cases of extreme emergency.

As a result of research work conducted to refine the design of the floating airport of the invention for construction purposes, several new concepts were developed that have general application to any large-scale floating structure. The first concept regards the assembly of the overall structure by a modular approach, wherein each module consists of a floating unit preferably capable of self-propulsion and releasably connected to an assembly of other modules. As illustrated schematically in the plan view of FIG. 10, each module 102 is connected to adjacent modules to form the continuous structure of a floating platform 100. The modules 102 of the example are shown as having a square configuration for ease of illustration, but obviously any geometry suitable for connection with other adjacent modules could be used to practice the invention. Similarly, the platform 100 is illustrated as having a ship-like configuration, but the modules 102 could be combined to yield any geometry suitable for the particular floating facility being constructed.

Figure 11:
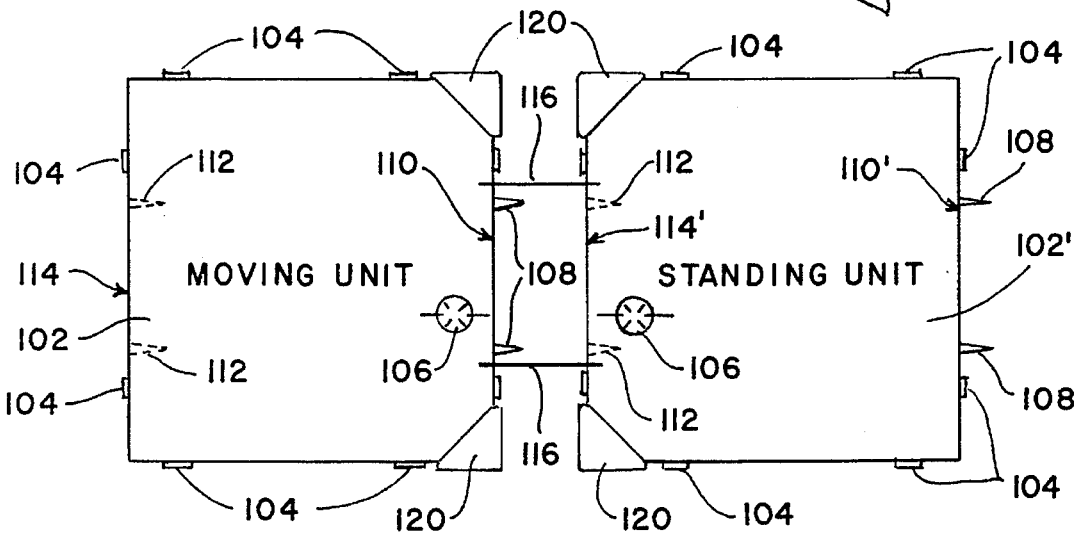
FIG. 11 is a schematic plan view of two modules of the structure of FIG. 10.
Figure 10:
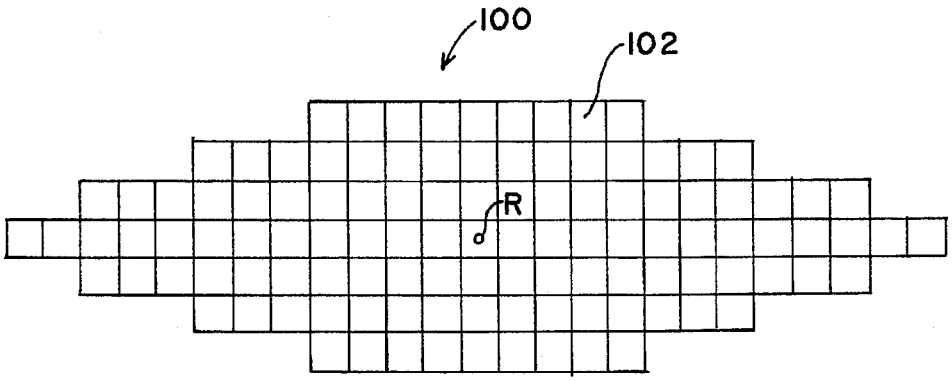
FIG. 10 is a schematic plan view of a floating platform structure constructed with the modular approach of the invention.

Each module 102 is self-supported as a floating unit and is independently self-propelled, so that it can be maneuvered for connection with other modules to form a floating structure of the type shown in FIG. 10. In order to safely connect each new module to the larger structure while both are floating at sea, it is essential that the two be brought into contact slowly and smoothly to protect them from damage, especially in high waves. To that end, the method of this invention is based on the concept of propelling the two floating structures in a diverging directions and by concurrently pulling them together, against the action of such propulsion, by means of tie lines. As illustrated schematically in plan view in FIG. 11, each module 102 is equipped with maneuvering jets 104 that allow it to move in any direction and position itself with respect to another module floating in its proximity, whether the latter is standing alone (as seen in FIG. 11) or connected to a larger composite structure such as 100.

According to the method of the invention, one module (such as 102' in FIG. 11, for example) is preferably controlled to be stationary on the water while the other module 102 is independently maneuvered to its proximity. The objective is to bring the two modules as close as possible to one another for connection to form a single structure while avoiding impacts that may damage them. Therefore, module 102 is brought to within a distance from module 102' considered safe for the particular sea conditions. For a module 300 feet long, it is anticipated that a safe distance under normal conditions would be about 50 feet. Each module is equipped with position monitor and control apparatus 106 for position control between modules, so that the relative attitude of the modules at sea can be controlled reliably within tolerances acceptable for slowly and safely navigating them in the proximity of one another. For example, the apparatus 106 may consist of a sighting device fixed to the deck of each module 102 and adapted by feedback control to activate the maneuvering jets 104 so as to obtain a desired alignment or positioning of the modules with respect to each other. For the purpose of connecting two modules, they are brought into substantially-parallel alignment, as illustrated in FIGS. 10 and 11, preferably by keeping one unit standing, such as 102' and maneuvering the other unit into position Each module is preferably equipped with male and female connectors adapted for mating engagement when they are aligned according to a predetermined plan of assembly for the modules, so that the initial connection between two modules is facilitated. For example, male connectors 108, preferably retractable, are protruding from one side 110 of each module 102, while conforming female connectors 112 are positioned in alignment therewith on the opposite side 114. These connectors are preferably conical in shape, or otherwise tapered forward, to facilitate the initial engagement between male and female members and progressively improve the alignment between the modules as they are pulled together to produce the desired connection. During the docking procedure, as illustrated in FIG. 11, two modules such as 102 and 102' are maneuvered by means of the position monitor and control apparatus 106 to align each other at a safe distance to avoid collision between the two structures. Then at least two tie lines 116 are cast and strung between the modules and are used to pull the modules together while the maneuvering jets 104 are operated at relatively-low power to maintain alignment and at the same time thrust the modules apart. As a result of this procedure, the tie lines are maintained taut and can be used advantageously to smoothly and safely connect the modules against the thrust of the jets 104. The tie lines 116 are drawn by means of winch devices 118 until the male connectors 108 can safely be extended (preferably from a retracted position) to reach into the female connectors 112, and then they are further drawn to effect the docking of the modules. Protective pads 120 may be utilized to protect the sides of the modules during the operation and removed after engagement of the male and female connectors 108,112, prior to final contact between the structures. After docking is completed, the modules are secured to one another by means of conventional fastening devices, such as large bolt assemblies 121, normally used to connect large structures.

Thus, according to this method of assembly, conforming modular units 102 equipped with propulsion means 104, position monitor and control means 106, engageable connector means 108,112 and retractable tie-line means 116,118 can be safely docked and connected to form a single unit while afloat at sea. By repeating the procedure with each additional module 102, a large floating platform can be constructed with a predetermined configuration, as deemed suitable for the particular facility for which the platform is intended.

It is noted that the modular approach of the present invention is directed to the construction of very large platforms that would involve the assembly of dozens, perhaps hundreds, of modules. The resulting structures are therefore expected to span over thousands of feet and require a certain degree of flexibility to absorb the stresses imparted by the motion of the underlying water waves under all weather conditions. On the other hand, the assembled structure must retain the degree of rigidity necessary for its intended purpose. For example, if the floating platform is used as a base for a commercial resort, its surface must be sufficiently rigid to support comfortable housing and recreational facilities. This problem requires a system of shock absorption that protects the deck structure of the platform and allows it to withstand great stresses with minimal bending, torsion, and vertical translation. This is achieved by providing each module 102 with an independent shock absorbing system capable of accommodating local water conditions, thus minimizing the transfer of vertical forces to adjacent modules.

Figure 13:
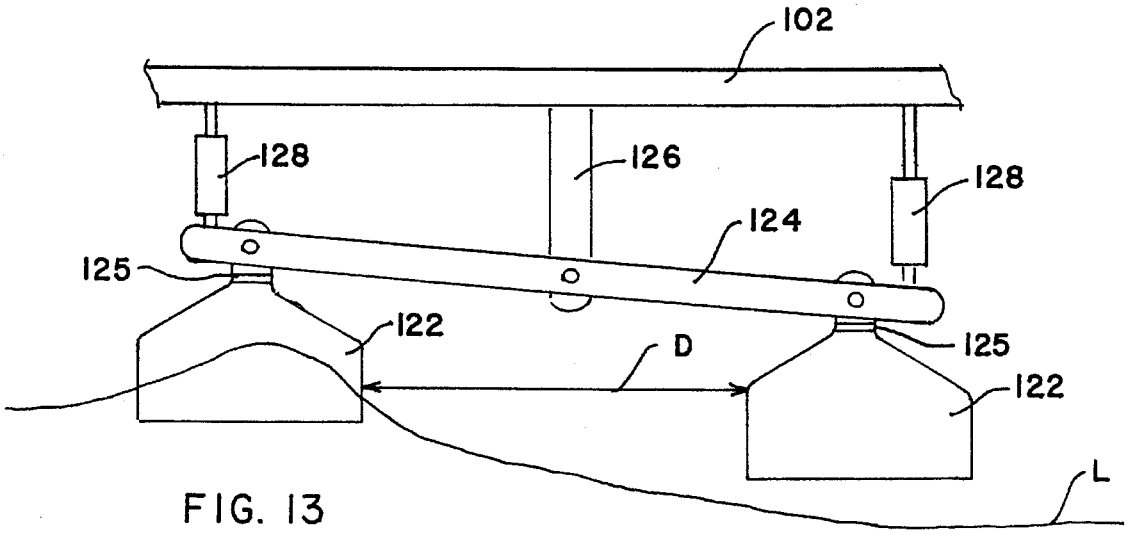
FIG. 13 is a schematic side view of the walking-beam pontoon structure of the invention.

The preferred method for implementing the shock-absorption system of the invention consists of pairs of pontoons connected to the modules by means of a walking-beam structure kept in balance by stretchable tensioning mechanisms. As illustrated in FIG. 13, the floating hulls of the embodiment shown in FIG. 1 are replaced with pairs of pontoons 122, each pontoon being pivotally mounted on one side of a normally-horizontal beam 124. The beam 124 is itself pivotally coupled, through a fulcrum point substantially at its midsection, to a vertical beam 126 anchored to the bottom side of modules 102. The resulting structure allows each pontoon 122 to move up and down in response to the motion of the water supporting the floating platform to conform to its surface level L as waves pass through, thereby absorbing vertical forces simply by changing the level of each pontoon 122, rather than by forcing the vertical movement of the modules 102. That is, as a wave front pushes one pontoon 122 upward, the other pontoon in the pair is pushed downward by the lever arm action of beam 124. In addition, each pontoon may be capable of rotational movement through vertical bearings 125 to adapt to changes in the direction of the prevailing wind and is preferably equipped with splash trays and scuppers to minimize the impact of waves striking the underside of the module.

Figure 15:
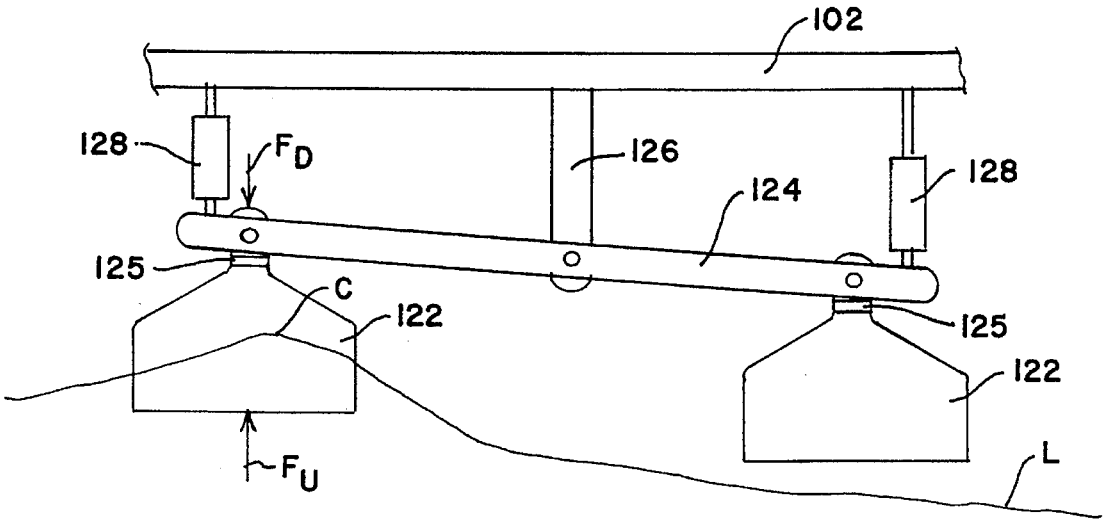
FIG. 15 is an illustration of the forces acting on the pontoon system of FIG. 13.
Figure 14:
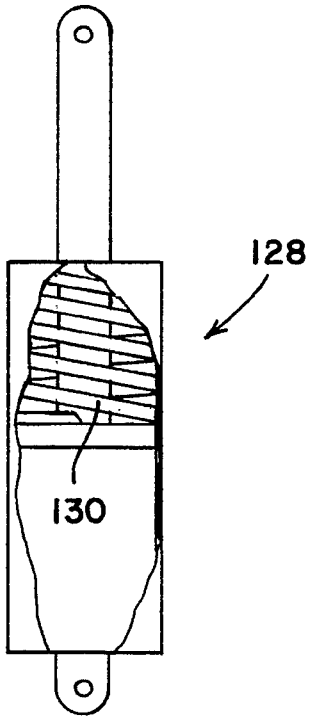
FIG. 14 is a partially-cut-out elevational view of an extendable tensioning mechanism according to the invention.

The stability of this walking-beam structure is greatly improved by anchoring each side of the beam 124, most efficiently the ends thereof, to the module 102 above by means of extendable tensioning mechanisms 128 adapted to pull each end of the beam 124 upwards. Such a mechanism could consist of a piston-cylinder assembly biased toward a contracted position by a spring 130, as illustrated in FIG. 14, or by gas pressure or other equivalent means. It is noted that this arrangement is opposite to that of conventional shock absorbers, which are always biased toward an extended position in order to absorb compressive forces. As illustrated schematically in FIG. 15, by operating in pairs, the mechanisms 128 still provide a downward force $F_D$ to counter the upward force $F_U$ produced by a wave's crest C. That is because the compressive bias of each unit 128 is opposed and balanced by the compressive bias of the other unit which, through the fulcrum point and the level-arm effect of the beam 124, produces an extensive force ($F_D$) operating on the first unit. Thus, because. of this contribution by the second unit, this configuration produces a faster response than the single shock-absorption device illustrated in FIGS. 5 and 9.

Figure 16:
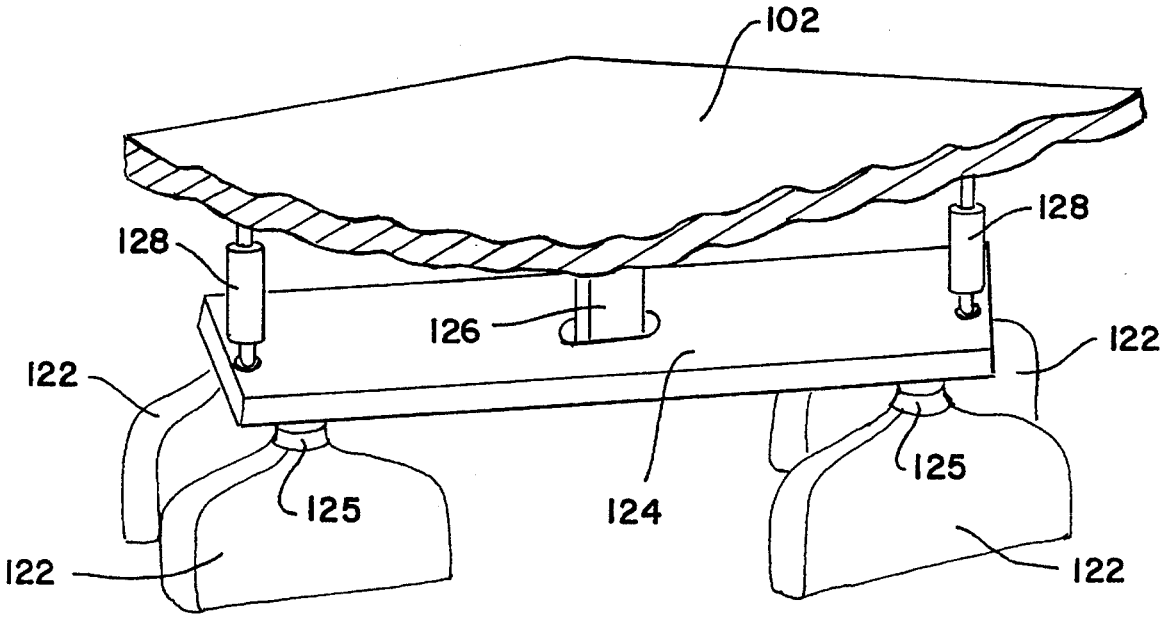
FIG. 16 is a perspective illustration of a four-pontoon walking-beam system according to the invention.

It is noted that more than one pair of pontoons 122 could equivalently be coupled to operate together responsive to a single set of tensioning mechanisms 128, as illustrated in FIG. 16. Moreover, since each module 102 is independently capable of flotation, sufficient pairs of pontoons 122 must be provided to ensure stability of the module before assembly with the larger floating platform 100. As in the case of the embodiment of FIGS. 1, 5 and 6, each pontoon 122 can be removable from the floating structure for maintenance and repair purposes.

Figure 17:
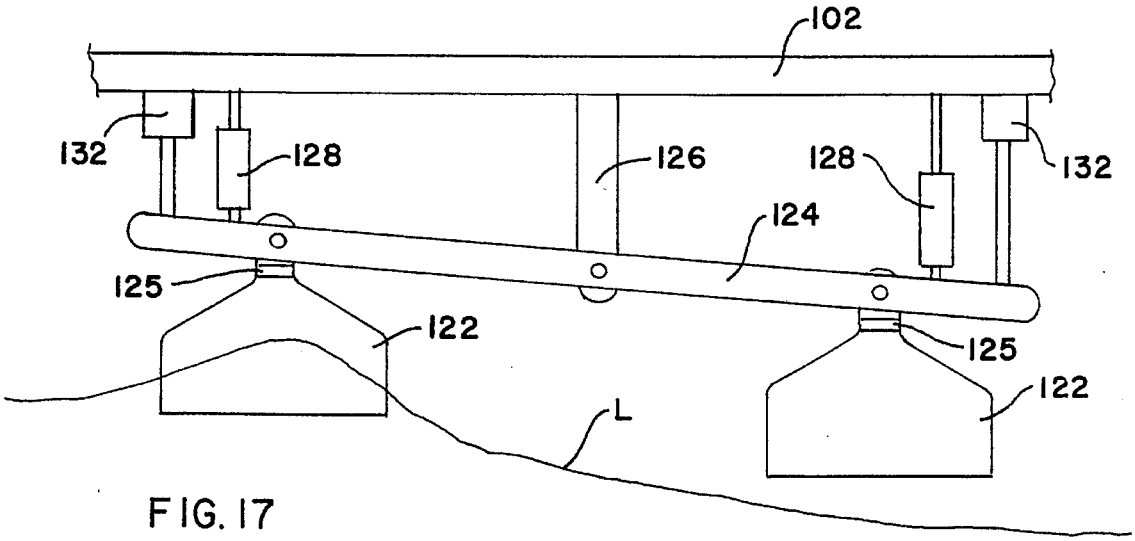
FIG. 17 is a schematic illustration of a system for generating usable energy from the motion of the walking beam of the invention.

Finally, the support structure of the invention is suitable for converting the energy absorbed from striking waves into usable energy onboard. As shown in FIG. 17, means 132 for harnessing and storing the energy generated by the motion of the beam 124 can easily be added to the walking-beam mechanism of the invention. For example, the means 132 could consist of a hydraulic displacement device actuated by the oscillations and corresponding stroking motion of the beam 124 and adapted to pump a liquid into a reservoir on the floating platform, thereby storing the liquid for future use to convert its potential energy into electrical energy through a turbine-driven generator. Similarly, means 132 could consist of a turbine actuated by the displacement of the beam 124 and directly connected to a generator for producing electricity to be used online or stored in electrical batteries.

Various modifications are possible within the meaning and range of equivalence of the appended claims. Therefore, while the present invention has been shown and described herein in what is believed to be the most practical and preferred embodiments, it is recognized that departures can be made therefrom within the scope of the invention, which is not to be limited to the details disclosed herein, but is to be accorded the full scope of the claims so as to embrace any and all equivalent apparatus and methods.

I claim:

1. A floating platform comprising;

a plurality of independently buoyant modules releasably and flexibly connected to one another to form a single structure, wherein each module comprises at least one walking-beam pontoon system, propulsion means and means for fastening said module to said structure, said walking-beam pontoon system comprising:

a substantially rigid beam having two ends and a midsection pivotally mounted on a fulcrum in the module; and at least one pontoon mounted substantially at each end of said beam.

2. The floating platform of claim 1, wherein each module further comprises position monitor and control means for aligning said module to the other modules.

3. The floating platform of claim 1, wherein each module further comprises engageable connector means for facilitating the initial connection of said module to the other modules.

4. The floating platform of claim 1, wherein each module further comprises retractable tie-line means for coupling said module to said structure and for docking the module to the structure.

5. The floating platform of claim 1, further comprising tensioning mechanisms adapted to pull each end of said beam upwards.

6. The floating platform of claim 5, wherein said tensioning mechanisms consist of a pair of piston-cylinder assemblies biased toward a contracted position.

7. The floating platform of claim 1, further comprising energy-generation means for converting a motion of said walking-beam pontoon system into usable energy.

8. The floating platform of claim 3, wherein said engageable connector means consists of male and female connectors adapted for mating engagement therebetween during the process of docking each of said modules to another module.

9. The floating platform of claim 8, wherein said male connectors are retractable.

10. The floating platform of claim 9, wherein said male connectors are conical.

11. A floating platform comprising:

a plurality of independently buoyant modules connected to one another to form a single structure, wherein each module comprises propulsion means and means for fastening said module to said structure;

means for determining an angular deviation between said platform's longitudinal axis and a direction of a prevailing wind;

means for determining a translational deviation between a predetermined vertical axis of rotation in said platform and a stationary vertical reference axis;

means for effecting a rotation of said platform about said predetermined vertical axis of rotation so as to minimize said angular deviation, thereby causing the platform to be positioned substantially windwardly; and means for effecting a translational movement of said predetermined vertical axis of rotation in the structure toward said stationary vertical reference axis so as to minimize said translational deviation, thereby causing said two axes to substantially coincide;

whereby the floating platform is maintained in a windward position approximately at rest with respect to said stationary vertical reference axis.

12. The floating platform of claim 11, wherein each module further comprises position monitor and control means for aligning said module to the other modules.

13. The floating platform of claim 11, wherein each module further comprises engageable connector means for facilitating the initial connection of said module to the other modules.

14. The floating platform of claim 11, wherein each module further comprises retractable tie-line means for coupling said module to a structure and docking the module to said structure.

15. The floating platform of claim 11, wherein each module comprises at least one walking-beam pontoon system, said system comprising:

a beam having two ends and a midsection pivotally mounted on a fulcrum in the module; and at least one pontoon mounted substantially at each end of said beam.

16. The floating platform of claim 15, further comprising tensioning mechanisms adapted to pull each end of said beam upwards.

17. The floating platform of claim 15, further comprising energy-generation means for converting a motion of said walking-beam pontoon system into usable energy.

18. A floating structure comprising:

a horizontal platform having an upper side and a lower side; and at least one walking-beam pontoon system, wherein said system comprises a substantially rigid beam having two ends and a midsection pivotally mounted on fulcrum means attached to said lower side of the platform, and at least one pontoon mounted substantially at each end of said beam.

19. The floating structure of claim 18, further comprising tensioning mechanisms adapted to pull each end of said beam upwards.

20. A method of assembling a floating platform comprising a plurality of independently buoyant modules connected to one another to form a single structure, wherein each module comprises propulsion means, fastening means for rigidly attaching said module to another module, position monitor and control means for aligning said module to the other module, retractable tie-line means for coupling said two modules, and engageable connector means for facilitating the initial connection of said two modules, the method comprising the following steps:

(a) positioning a module in predetermined alignment with another module using the position monitor and control means and the propulsion means;

(b) coupling said two modules using the retractable tie-line means;

(c) engaging said connector means between the two modules;

(d) pulling the two modules together using the tie-line means while at the same time operating the propulsion means at relatively-low power to maintain said predetermined alignment and to thrust the two modules apart; and (e) attaching said two modules to one another using the fastening means;

whereby the tie-line means is used advantageously to smoothly and safely connect said two modules against the thrust of the propulsion means.

* * * * *